US010724207B2

(12) United States Patent
Showley et al.

(10) Patent No.: US 10,724,207 B2
(45) Date of Patent: Jul. 28, 2020

(54) REMOTE DEBRIS TANK AND RELATED METHODS

(71) Applicant: VAC-TRON EQUIPMENT, LLC, Okahumpka, FL (US)

(72) Inventors: Brian Showley, Leesburg, FL (US); Don M. Buckner, Okahumpka, FL (US)

(73) Assignee: VAC-TRON EQUIPMENT, LLC, Okahumpka, FL (US)

( * ) Notice: Subject to any disclaimer, the term of this patent is extended or adjusted under 35 U.S.C. 154(b) by 812 days.

(21) Appl. No.: 15/454,428

(22) Filed: Mar. 9, 2017

(65) Prior Publication Data

US 2017/0183843 A1 Jun. 29, 2017

Related U.S. Application Data

(63) Continuation of application No. 12/984,590, filed on Jan. 4, 2011, now Pat. No. 9,719,230.
(Continued)

(51) Int. Cl.
*E02F 3/88* (2006.01)
*E02F 3/92* (2006.01)
(Continued)

(52) U.S. Cl.
CPC ..... *E02F 3/9243* (2013.01); *E02F 3/88* (2013.01); *E02F 3/8825* (2013.01); *E02F 3/90* (2013.01);
(Continued)

(58) Field of Classification Search
CPC ..... B01D 50/002; B65D 88/30; B65D 88/66; B65G 53/24; B65G 54/66; E02F 3/8825; E02F 3/90; E02F 3/9143; E02F 3/88; E02F 9/2271; E01H 1/0863; E01H 1/0809
USPC ..... 37/195, 317–323; 15/340.1; 55/302, 55/356, 432, 459.1; 222/202, 203; 406/168, 145, 34, 36, 173
See application file for complete search history.

(56) References Cited

U.S. PATENT DOCUMENTS 3,815,514 A 6/1974 Heap
3,990,125 A 11/1976 Saiia
(Continued)

OTHER PUBLICATIONS

Brochure for FlowMaster 350 Series, 2007.
(Continued)

*Primary Examiner* — Robert E Pezzuto
(74) *Attorney, Agent, or Firm* — Allen, Dyer et al.

(57) ABSTRACT

A remote debris tank includes a housing having a top and a bottom discharge opening, a pair of discharge doors mounted to opposing lateral sides of the bottom discharge opening and configured for pivotal movement between an open position and a closed position, and an actuating shaft operably coupled to the first and second discharge doors. The remote debris tank also includes a crank lever having a plurality of vertices, where the crank lever is secured to the actuating shaft at a first vertex and configured to rotate with the actuating shaft. A first radial arm has a first end articulately connected to a second vertex of the crank lever and a second end articulately connected to the first discharge door. Similarly, a second radial arm is articulately connected to a third vertex of the crank lever and extending away from the actuating shaft to the second discharge door.

20 Claims, 5 Drawing Sheets

Related U.S. Application Data

(60) Provisional application No. 61/292,006, filed on Jan. 4, 2010.

(51) Int. Cl.

| | |
|---|---|
| ***B65D 88/00*** | (2006.01) |
| ***E02F 3/90*** | (2006.01) |
| ***E02F 9/22*** | (2006.01) |
| *E01H 1/08* | (2006.01) |

(52) U.S. Cl.
CPC ..... *E02F 9/2271* (2013.01); *E01H 1/0809* (2013.01); *E01H 1/0863* (2013.01)

(56) References Cited

U.S. PATENT DOCUMENTS

| | | | | |
|---|---|---|---|---|
| 4,121,915 | A | 10/1978 | Anderson | |
| 4,199,837 | A | 4/1980 | Fisco, Jr. | |
| 4,218,226 | A | 8/1980 | Boozer | |
| 4,922,571 | A | 5/1990 | Driear | |
| 4,925,356 | A | 5/1990 | Snead et al. | |
| 5,030,259 | A | 7/1991 | Bryant et al. | |
| 5,141,528 | A | 8/1992 | Boczkiewicz et al. | |
| 5,212,891 | A | 5/1993 | Schuermann et al. | |
| 5,487,228 | A * | 1/1996 | Marazzo ..... | B65D 88/66 222/202 |
| 5,598,647 | A * | 2/1997 | Marazzo ..... | B65D 88/66 222/202 |
| 5,791,073 | A * | 8/1998 | Palmer ..... | B65G 53/24 222/202 |
| 6,279,487 | B1 | 8/2001 | Gaydos et al. | |
| 6,385,867 | B1 | 5/2002 | Slabach et al. | |
| 6,413,020 | B1 * | 7/2002 | Davison ..... | B65G 53/24 406/145 |
| 6,453,584 | B1 | 9/2002 | Buckner | |
| 6,604,304 | B1 | 8/2003 | Slabach et al. | |
| 6,615,849 | B1 | 9/2003 | Gilman et al. | |
| 6,988,568 | B2 | 1/2006 | Buckner | |
| 7,503,134 | B2 | 5/2009 | Buckner | |
| 7,604,023 | B2 | 10/2009 | Buckner et al. | |
| 7,644,523 | B2 | 1/2010 | Buckner | |
| 7,735,186 | B1 | 6/2010 | Vogel | |
| 7,837,050 | B2 | 11/2010 | Maybury, Jr. | |
| 2005/0166350 | A1 | 8/2005 | Buckner | |
| 2006/0032012 | A1 | 2/2006 | Buckner | |
| 2006/0236499 | A1 | 10/2006 | Cappellotto | |
| 2008/0040945 | A1 | 2/2008 | Buckner | |
| 2011/0296646 | A1 | 12/2011 | Showley | |

OTHER PUBLICATIONS

Webpage for Vacmasters System 4000, http://www.vacmasters.com/air4000.htm, Vacmasters, Arvada, CO., 2011.

J. Griffin, "Bess Testlab Finds Many Uses for Air Vac Systems", "Rehabilitation Guide", Underground Construction, Jul. 2005.

* cited by examiner

REMOTE DEBRIS TANK AND RELATED METHODS

CROSS-REFERENCE TO RELATED APPLICATIONS

This application is a continuation of pending U.S. patent application Ser. No. 12/984,590 filed Jan. 4, 2011 which claims priority to U.S. provisional application Ser. No. 61/292,006 filed on Jan. 4, 2010, all the contents of which are herein incorporated by reference in their entirety.

TECHNICAL FIELD

The present invention relates to the field of vacuum excavation, and, more particularly, to a remote debris tank used for excavations and related methods.

BACKGROUND

Portable vacuum systems can be used to remove a variety of wet and dry material. Some applications include storm drain clean out, locating underground utilities, cleanup at treatment plants, vacuuming out retention ponds, cleaning out of lateral lines, excavation of small rocks and dry sand, mud removal, manhole clean out, meter box cleaning, saw mill clean up, and emergency road spills. Such systems are typically either mounted on a truck or a trailer, to facilitate their transportation. Examples of such systems are disclosed in the following patents and published applications, the disclosures of which are hereby incorporated by reference: U.S. Pat. No. 6,385,867 to Slabach et al. for "System for Vacuum Excavation;" U.S. Pat. No. 6,453,584 to Buckner for "Continuous Vacuum, Separator, Dispensing System;" U.S. Pat. No. 6,604,304 to Slabach et al. for "Dual Mode Evacuation System for Vacuum Excavator;" U.S. Pat. No. 6,988,568 to Buckner for "Vacuum Boring and Mud Recovery System;" U.S. Pat. No. 7,503,134 to Buckner for "Fixed Slope Vacuum Boring and Mud Recovery System;" U.S. Pat. No. 7,604,023 to Buckner et al. for "Utility Valve Access and Performance Evaluation Means," U.S. Pat. No. 7,644,523 to Buckner for "Mobile Vacuum Boring and Excavation Method;" U.S. Pat. No. 7,837,050 to Maybury, Jr. for "Collection Tank;" and U.S. patent application Pub. No. 2006/0032012 to Lynn Buckner for "Mobile Vacuum Boring and Mud Recovery Method Having an Articulated Vacuum Conduit Boom with Digging Bucket."

These vacuum systems are often used in connection with hydro excavation systems that use a stream of fluids, usually air or water, to dislodge earth. The vacuum is then used to draw water with solids from the excavation into a storage tank.

In some applications, it is desirable to be able to return the material from the storage tank to the hole, for example after the underground utility has been serviced. It may also desirable to be able to separate wet material from the dry material. One system that provides for separate storage of wet and dry material is the Vacmasters System 4000 as sold by Vacmasters of Arvada, Colo. The System 4000 includes a primary storage tank and a smaller secondary storage tank. Both tanks are fixedly mounted on the body of a truck. The secondary tank can be used, for example, to store dry material in potholing applications. In order to return the dry material to the hole with this design, it is necessary to maneuver the truck to position the tank over the hole, or alternatively to manually move the material, e.g., using a wheelbarrow, from the storage tank to the hole.

SUMMARY

In view of the foregoing background, it is therefore an object of the present invention to provide a remote debris tank that is maneuverable separately from vacuum equipment mounted to a trailer or truck, and can be used to store excavating material temporarily until such time as the excavation material is needed to be placed back into a desired location. In a particular embodiment, the excavation remote debris tank includes a housing having a top and a bottom discharge opening. The remote debris tank also includes a first discharge door that is mounted to a first lateral side of the bottom discharge opening and is configured for pivotal movement about a horizontal axis between an open position and a closed position, and a second discharge door that is mounted to an opposing second lateral side of the discharge opening and configured for pivotal movement about the horizontal axis between the open and closed positions. The first and second discharge doors are configured to divergently move relative to one another on opposing lateral sides to define the discharge opening. In addition, an actuating shaft is operably coupled to the first and second discharge doors, and a crank lever having a plurality of vertices is secured to the actuating shaft at a first vertex and configured to rotate with the actuating shaft. A first radial arm is coupled to a second vertex of the crank lever and extends away from the actuating shaft to the first discharge door, and a second radial arm is coupled to a third vertex of the crank lever and extending away from the actuating shaft to the second discharge door.

In a particular exemplary embodiment, the first radial arm comprises an arc having a first end articulately connected to the second vertex of the crank lever, and a second end articulately connected to the first discharge door. Similarly, the second radial arm comprises an arc having a first end articulately connected to the third vertex of the crank lever, and a second end articulately connected to the second discharge door. In a particular embodiment, the crank lever comprises a triangular shape defined by the first, second, and third vertices, and an actuator may be coupled to the actuating shaft, where the actuator is configured to rotate the actuating shaft. In addition, the remote debris tank may include a boom having a first end and a second end, where the first end is coupled to the top of the housing and cantilevered out from the second end to suspend the housing, and the boom is configured to rotate the housing relative to the second end.

The remote debris tank may also include an actuator, a drive chain, a drive sprocket coaxially coupled to the actuator where the actuator is configured to rotate the drive sprocket and drive the drive chain, and a sprocket gear coaxially coupled to the actuating shaft where the sprocket gear meshes with the drive chain and is configured to rotate the actuating shaft in response to the sprocket gear rotating.

In another embodiment, a method to excavate using a remote debris tank is disclosed. The debris tank includes a housing having a top and a bottom discharge opening, and a pair of discharge doors mounted to opposing lateral sides of the bottom discharge opening and configured for pivotal movement about a horizontal axis between an open position and a closed position. The debris tank also includes an actuating shaft operably coupled to the first and second discharge doors, and a crank lever having a plurality of vertices, where the crank lever is secured to the actuating shaft at a first vertex and configured to rotate with the actuating shaft.

In addition, a first arc shaped radial arm has a first end that is articulately connected to a second vertex of the crank lever and a second end that is articulately connected to the first discharge door, and a second arc shaped radial arm is coupled to a third vertex of the crank lever and extends away from the actuating shaft to the second discharge door. The method includes rotating the actuating shaft to the closed position using an actuator until the pair of discharge doors are locked to close the bottom discharge opening. The method also includes excavating material into the remote debris tank using a vacuum hose, and rotating the actuating shaft to the open position using the actuator in order to dump the material from the remote debris tank through the discharge opening using gravity when emptying the remote debris tank.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
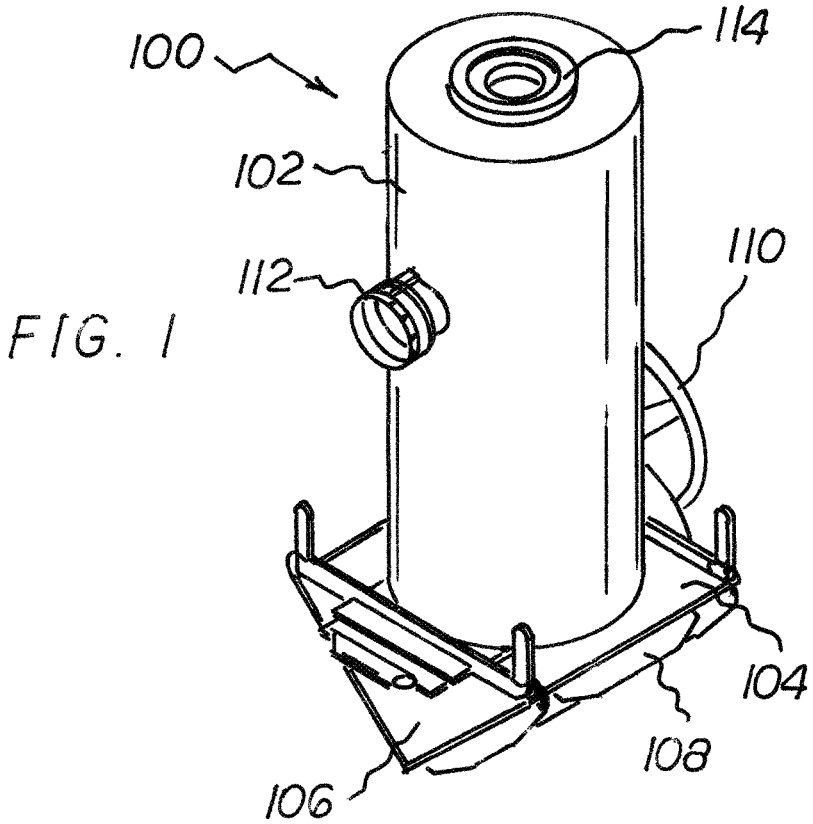
FIG. 1 is a top perspective view of a particular embodiment of a remote debris tank of the invention with discharge doors in a closed position.
Figure 2:
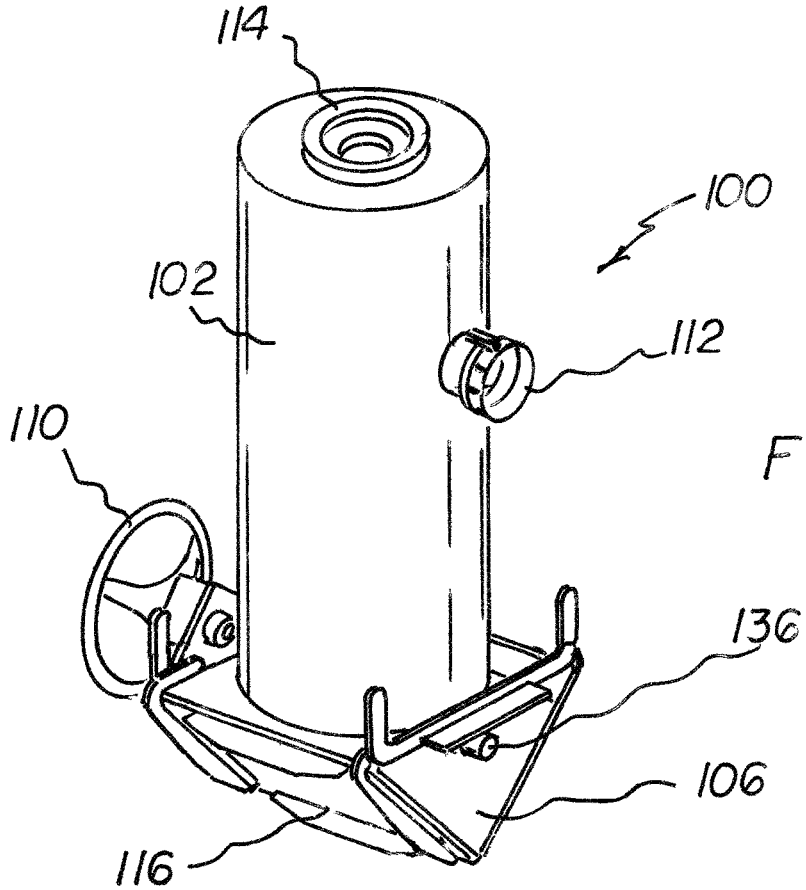
FIG. 2 is a left side perspective view of the remote debris tank.

Referring now to the FIGS. 1 and 2, a remote debris tank 100 is in a closed position according to one embodiment of the present invention. The remote debris tank, generally designated by reference numeral 100, includes a walled enclosure or housing 102 for storing excavation material. As diagrammatically illustrated, the housing 102 has a generally cylindrical shape. The housing 102 includes a bottom support 104 and a front side support 106 mounted along an edge of the bottom support 104. A first discharge door 108 is mounted below the bottom support 104 and adjacent to the front side support 106.

An actuator 110 is mounted to a rear portion of the housing 102 and is used to rotate an actuating shaft 136 discussed in more detail below. The actuator 110 is a wheel in this particular embodiment, however, the actuator 110 could be pneumatic, hydraulic, or of some other similar device that is configured to rotate the actuating shaft 136.

A suction port 112 is mounted to a front portion of the housing 102 and is used to secure a suction hose thereto and provides a conduit to an interior space of the housing 102. A top coupling 114 is secured to a top portion of the housing 102 and is used to secure a suction conduit that provides vacuum to the interior space of the housing 102. The top coupling 114 may also be configured to receive an end of a boom so that the housing 102 can be suspended and maneuvered by the boom to a desired location.

Figure 3:
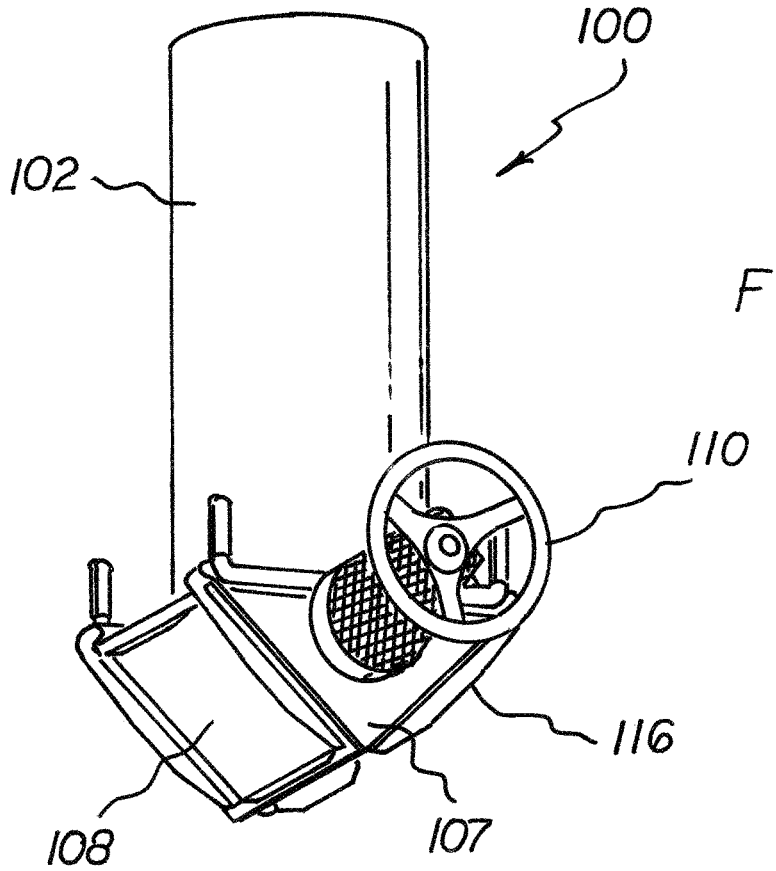
FIG. 3 is a rear perspective view of the remote debris tank.

The actuator 110 is shown in more detail in FIG. 3, and can be seen that the actuator 110 is secured to a mechanism, mounted to a rear side panel 107, that transfers the movement of the actuator 110 to the actuating shaft 136. The first discharge door 108 is mounted to a first lateral side of the discharge opening and is configured for pivotal movement about a horizontal axis between an open position and a closed position. The second discharge door 116 is mounted to an opposing second lateral side of the discharge opening and is configured for pivotal movement about the horizontal axis between the open and closed positions. The first and second discharge doors 108, 116 are configured to divergently move relative to one another on opposing lateral sides to define the discharge opening.

Figure 4:
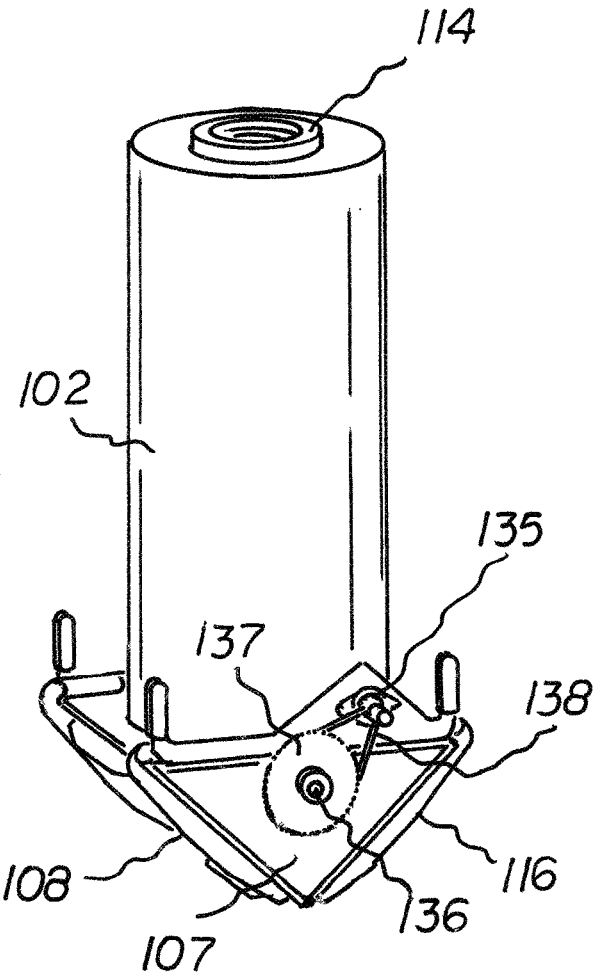
FIG. 4 is a rear elevation view of the remote debris tank with a cover removed showing a drive chain configured to rotate an actuating shaft.

Referring now to FIG. 4, the actuator 110 and the cover of the mechanism has been removed for clarity to show a drive chain 138, and a drive sprocket 135 coaxially coupled to the actuator 110. The actuator 110 is configured to rotate the drive sprocket 135 and drive the drive chain 138. A sprocket gear 137 is coaxially coupled to the actuating shaft 136, and the sprocket gear 137 meshes with the drive chain 138 and in turn rotates the actuating shaft 136 in response to the sprocket gear 135 rotating.

Figure 5:
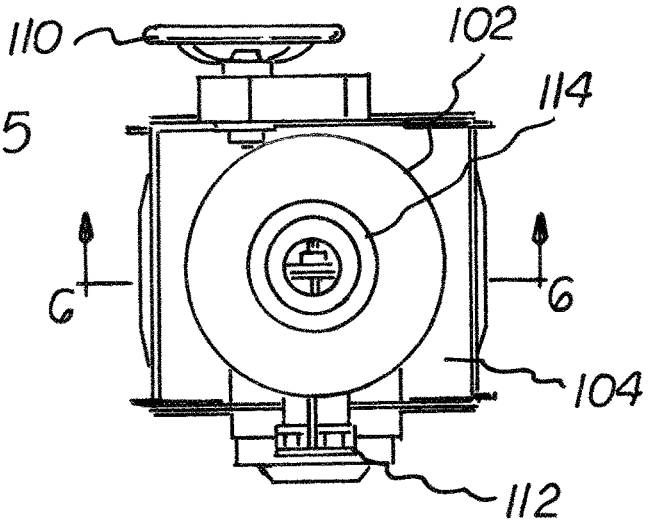
FIG. 5 is a top view of the remote debris tank.

Referring now to FIG. 5, a top view of the remote debris tank 100 is shown. As described above, the debris tank 100 includes a top coupling 114 disposed centrally within a top portion of the housing 102. The bottom portion of the housing 102 includes the bottom support 104, which may be rectangular shaped in a particular embodiment. The bottom support 104 forms the support for the front and rear side panels 106, 107 to suspend from opposing edges of the bottom support 104. The first and second discharge doors 108, 116 are mounted perpendicular to each of the side panels 106, 107 along remaining edges of the bottom support 104.

Figure 6:
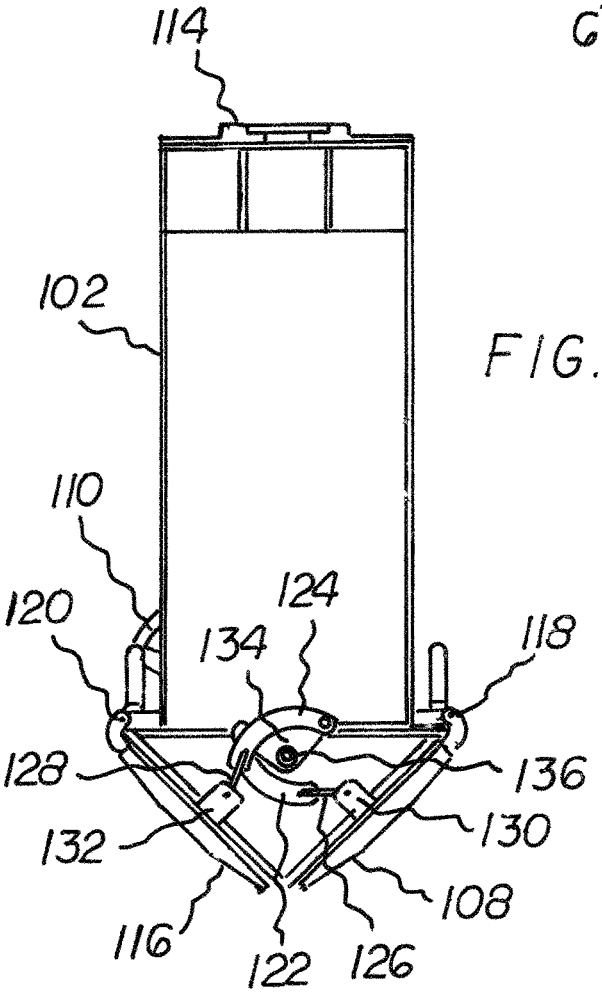
FIG. 6 is a front cross sectional view taken in the direction of line 6-6 of FIG. 5.

Referring now to FIG. 6, the front side panel 106 has been removed in this cross sectional view taken in the direction of line 6-6 of FIG. 5, in order to view the crank lever 134. The crank lever 134 is defined by a plurality of vertices, and is secured to the actuating shaft 136 at a first vertex and configured to rotate with the actuating shaft 136. A first radial arm 122 is coupled to a second vertex of the crank lever 134 and extends away from the actuating shaft 136 to the first discharge door 108. Similarly, a second radial arm 124 is coupled to a third vertex of the crank lever 134 and extends away from the actuating shaft 136 to the second discharge door 116, The first radial arm 122 comprises an arc having the first end articulately connected to the second vertex of the crank lever 134, and the second end articulately connected to the first discharge door 108 via a first anchor 130. The second radial arm 124 also comprises an arc having the first end articulately connected to the third vertex of the crank lever 134, and the second end articulately connected to the second discharge door 116 via second anchor 131. The crank lever 134 may generally comprise a triangular shape defined by the first, second, and third vertices.

In addition, a first horizontal axis 118 couples the first discharge door 108 to the bottom support 104. A second horizontal axis 120 couples the second discharge door 116 to an opposing edge of the bottom support 104.

Figure 7:
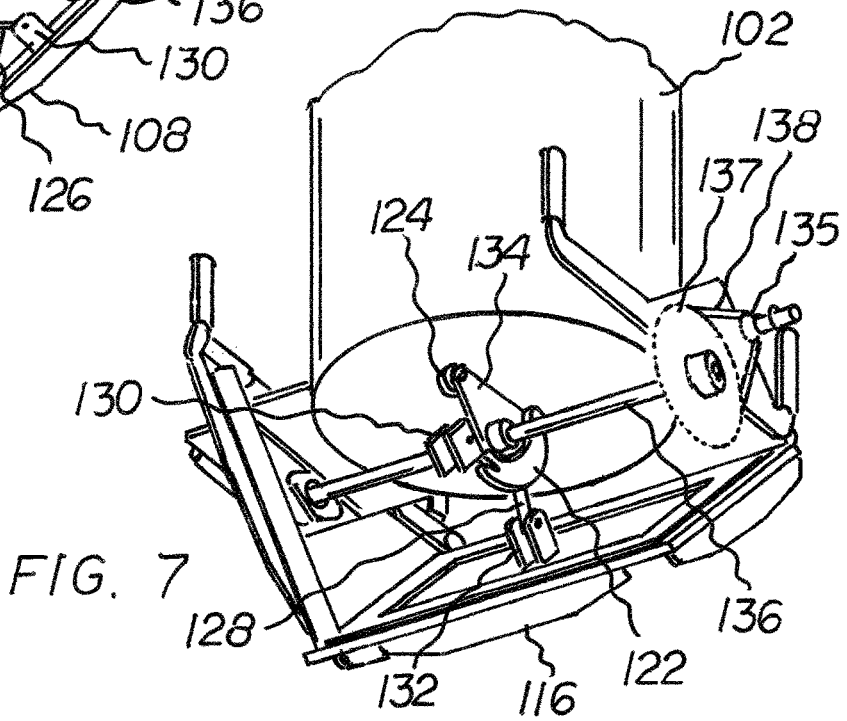
FIG. 7 is a bottom detail view with a discharge door removed showing a crank lever secured to the actuating shaft.

Referring now to FIG. 7, the first discharge door 108 and the rear side panel 107 have been removed for clarity. In addition, the cover over the drive chain 138 and drive sprocket 135 have been removed, and the actuator 110 has been removed for clarity. As described above, the actuator 110 is configured to rotate the drive sprocket 135 and drive the drive chain 138. The sprocket gear 137 is coaxially coupled to the actuating shaft 136, and the sprocket gear 137 meshes with the drive chain 138 and in turn rotates the actuating shaft 136 in response to the sprocket gear 135 rotating.

Figure 8:
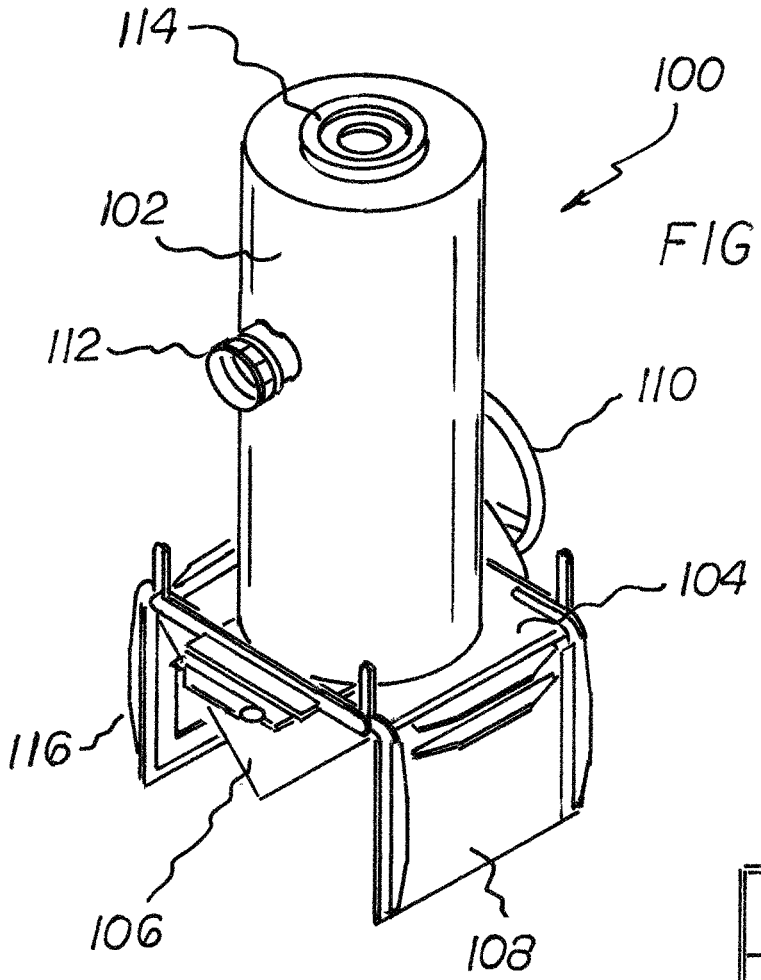
FIG. 8 is a top perspective view of the remote debris tank with the discharge doors in an open position.

The remote debris tank 100 is shown with the first discharge door 108 and the second discharge door 116 in the open position in FIG. 8. The excavation material inside the housing 102 is then released by gravity from the housing 102 when in the open position. As described above, the actuator 110 is rotated in order to rotate the actuating shaft 136 that in turn rotates the crank shaft 134.

Figure 9:
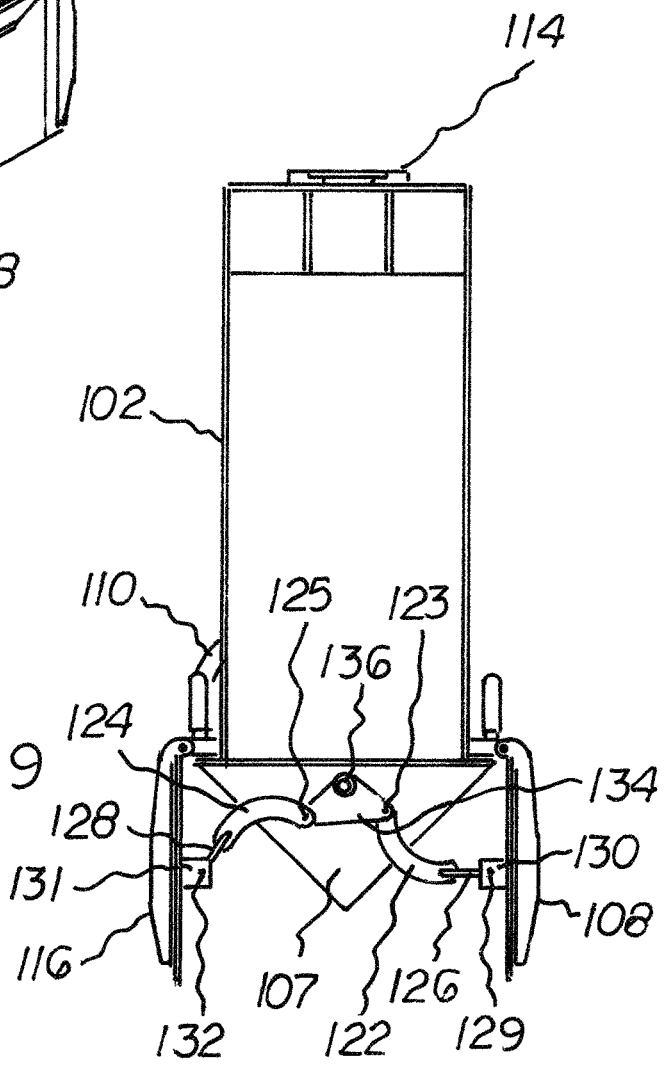
FIG. 9 is a front cross sectional view taken in the direction of line 8-8 of FIG. 8.

As shown in FIG. 9, the crank lever 134 has been rotated approximately one hundred eighty degrees from when the discharge doors 108, 116 were in the closed position as shown in FIG. 6. The first radial arm 122 has pushed the first discharge door 108 outwards from the actuating shaft 136 as the crank lever 134 rotated, and the second radial arm 124 has pushed the second discharge door 116 outwards as well in response to the crank lever 134 being rotated in a first direction. When the crank lever 134 is rotated in an opposing second direction by the actuating shaft 136, the first and second radial arms 122, 124 pull the first and second discharge doors 108, 116 closed as shown in FIG. 6, for example.

The divergently opening pair of discharge doors 108, 116 are arranged on the housing 102 in opposed relation relative to each other. The discharge doors 108, 116 are mounted to the housing 102 for movement between a closed position (FIG. 1) and an open position (FIG. 8). As shown, the discharge doors 108, 116 are preferably mounted to the housing 102 adjacent the longitudinal centerline of the housing 102 for pivotal movement. As shown in FIGS. 6 and 8, each discharge door 108, 116 is mounted to the housing 102 for pivotal movement about a generally horizontal axis disposed generally parallel and adjacent to the longitudinal centerline of the housing 102.

As will be appreciated from FIGS. 8 and 9, rotation of the actuating shaft 136, results in the pair of discharge doors 108, 116 being opened substantially simultaneously to empty the excavation material from the housing 102. Thus, substantially the entire bottom of the housing 102 is opened at once to permit rapid discharge of excavation material.

As schematically represented in FIGS. 6 and 9, the first and second radial arms 122, 124 are each preferably configured as an overcenter linkage mechanism and acts as a primary lock for the discharge doors 108, 116. That is, when the discharge doors 108, 116 are closed, the radial arms 122, 124 and articulate connections 123, 125 assume an overcenter position between the pivotal axis of the actuating shaft 136 and the respective articulated connections 129, 132 to the discharge doors 108, 116 to positively maintain and releasably lock the discharge doors 108, 116 in a closed position. As will be appreciated by those skilled in the art, the radial arms 122, 124 may include a respective first link 126 and a second link 128, and each radial arm and link are of substantially similar construction.

Figure 10:
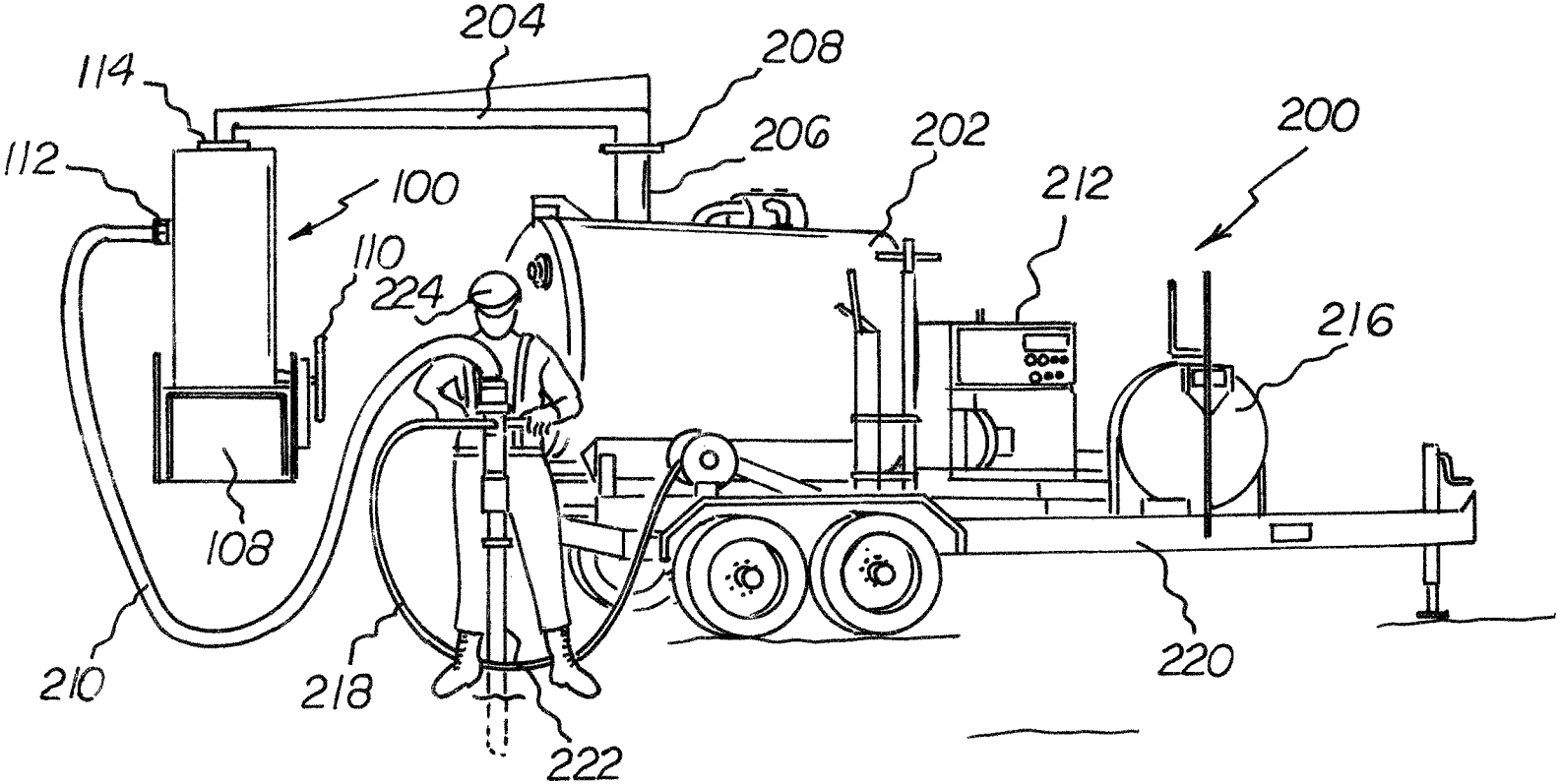
FIG. 10 is an elevational view of the remote debris tank mounted to a boom and trailer.

Referring now to FIG. 10, a boom 204 may be secured to the top of the housing 102 using the top coupling 114 and cantilevered out from a second end 208 to suspend the housing 102. The second end of the boom 208 is secured to the main debris tank 202 via stub 206. The main debris tank 202 is mounted to a trailer frame 220, which carries the excavation equipment 200. Alternatively, the excavation equipment 200 could be mounted to a truck or other mobile platform. The excavation equipment 200 includes a motor 212 to provide the suction to the remote debris tank 100, and can also be used to provide water pressure for a hose 218 used for hydro excavation. The hose 218 may be stored on a reel 216 that is mounted to the trailer frame 220.

In use, a user 224 grips the suction wand 222 and excavates material to the remote debris tank 100 through a suction hose 210. The boom 204 is configured to rotate the housing 102 relative to the second end 208. The boom 204 may also carry a suction conduit from the main debris tank 202 and be connected to the top of the housing 102. As described above, the housing 102 may include a suction port 112 and be configured to couple to the suction hose 210 for excavation.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A remote debris tank comprising:

a housing having a top and a discharge opening;

a first discharge door mounted to a first lateral side of the discharge opening and configured for pivotal movement about a horizontal axis between an open position and a closed position;

a second discharge door mounted to an opposing second lateral side of the discharge opening and configured for pivotal movement about the horizontal axis between the open and closed positions, the first and second discharge doors configured to divergently move relative to one another on opposing lateral sides to define the discharge opening;

an actuating shaft operably coupled to the first and second discharge doors;

a crank lever having a plurality of vertices, the crank lever secured to the actuating shaft at a first vertex and configured to rotate with the actuating shaft;

a first radial arm coupled to a second vertex of the crank lever and extending away from the actuating shaft to the first discharge door; and a second radial arm coupled to a third vertex of the crank lever and extending away from the actuating shaft to the second discharge door.

2. The remote debris tank of claim 1, wherein the first radial arm comprises an arc having a first end articulately connected to the second vertex of the crank lever, and a second end articulately connected to the first discharge door.

3. The remote debris tank of claim 2, wherein the second radial arm comprises an arc having a first end articulately connected to the third vertex of the crank lever, and a second end articulately connected to the second discharge door.

4. The remote debris tank of claim 1, wherein the crank lever comprises a triangular shape defined by the first, second, and third vertices.

5. The remote debris tank of claim 1, further comprising an actuator coupled to the actuating shaft, wherein the actuator configured to rotate the actuating shaft.

6. The remote debris tank of claim 1, further comprising a boom having a first end and a second end, the first end coupled to the top of the housing and cantilevered out from the second end to suspend the housing, wherein the boom is configured to rotate the housing relative to the second end.

7. The remote debris tank of claim 6, wherein the boom carries a suction conduit connected to the top of the housing.

8. The remote debris tank of claim 7, the housing further comprising a suction port and configured to couple to a suction hose for excavation.

9. The remote debris tank of claim 1, further comprising:

an actuator;

a drive chain;

a drive sprocket coaxially coupled to the actuator, the actuator configured to rotate the drive sprocket and drive the drive chain; and a sprocket gear coaxially coupled to the actuating shaft, and the sprocket gear meshing with the drive chain and configured to rotate the actuating shaft in response to the sprocket gear rotating.

10. An remote debris tank comprising:

a housing having a top and a bottom discharge opening;

a pair of discharge doors mounted to opposing lateral sides of the bottom discharge opening and configured for pivotal movement about a horizontal axis between an open position and a closed position;

an actuating shaft operably coupled to the first and second discharge doors;

a crank lever having a plurality of vertices, the crank lever secured to the actuating shaft at a first vertex and configured to rotate with the actuating shaft;

a first arc shaped radial arm having a first end articulately connected to a second vertex of the crank lever, and a second end articulately connected to the first discharge door;

a second arc shaped radial arm coupled to a third vertex of the crank lever and extending away from the actuating shaft to the second discharge door; and a boom having a first end and a second end, the first end coupled to the top of the housing and cantilevered out from the second end to suspend the housing, wherein the boom is configured to rotate the housing relative to the second end.

11. The remote debris tank of claim 10, wherein the crank lever comprises a triangular shape defined by the first, second, and third vertices.

12. The remote debris tank of claim 10, further comprising an actuator coupled to the actuating shaft, wherein the actuator is configured to rotate the actuating shaft.

13. The remote debris tank of claim 10, wherein the boom carries a suction conduit connected to the top of the housing.

14. The remote debris tank of claim 10, the housing further comprising a suction port and configured to couple to a suction hose for excavation.

15. The remote debris tank of claim 10, further comprising:

an actuator;

a drive chain;

a drive sprocket coaxially coupled to the actuator, the actuator configured to rotate the drive sprocket and drive the drive chain; and a sprocket gear coaxially coupled to the actuating shaft, and the sprocket gear meshing with the drive chain and configured to rotate the actuating shaft in response to the sprocket gear rotating.

16. A method to excavate using a remote debris tank having a housing having a top and a bottom discharge opening, a pair of discharge doors mounted to opposing lateral sides of the bottom discharge opening and configured for pivotal movement about a horizontal axis between an open position and a closed position, an actuating shaft operably coupled to the first and second discharge doors, a crank lever having a plurality of vertices, the crank lever secured to the actuating shaft at a first vertex and configured to rotate with the actuating shaft, a first arc shaped radial arm having a first end articulately connected to a second vertex of the crank lever and a second end articulately connected to the first discharge door, and a second arc shaped radial arm coupled to a third vertex of the crank lever and extending away from the actuating shaft to the second discharge door, the method comprising:

rotating the actuating shaft to the closed position using an actuator until the pair of discharge doors are locked to close the bottom discharge opening;

excavating material into the remote debris tank using a vacuum hose; and rotating the actuating shaft to the open position using the actuator in order to dump the material from the remote debris tank through the discharge opening using gravity when emptying the remote debris tank.

17. The method of claim 16, wherein the remote debris tank comprises a boom having a first end and a second end, the first end coupled to the top of the housing and cantilevered out from the second end to suspend the housing, wherein the boom is configured to rotate the housing relative to the second end.

18. The method of claim 16, wherein the crank lever comprises a triangular shape defined by the first, second, and third vertices.

19. The method of claim 17, wherein the boom carries a suction conduit connected to the top of the housing.

20. The method of claim 16, wherein the housing comprises a suction port and configured to couple to a suction hose for excavation.

* * * * *